US007566279B2

(12) United States Patent
Nakashima

(10) Patent No.: US 7,566,279 B2
(45) Date of Patent: Jul. 28, 2009

(54) GOLF CLUB AND KIT HAVING INTERCHANGEABLE HEADS AND SHAFTS

(75) Inventor: John M. Nakashima, Stockton, CA (US)

(73) Assignee: Nakashima Golf, Inc., Stockton, CA (US)

( * ) Notice: Subject to any disclaimer, the term of this patent is extended or adjusted under 35 U.S.C. 154(b) by 0 days.

(21) Appl. No.: 12/229,824

(22) Filed: Aug. 26, 2008

(65) Prior Publication Data

US 2008/0318704 A1 Dec. 25, 2008

Related U.S. Application Data

(63) Continuation of application No. 11/595,146, filed on Nov. 10, 2006, now abandoned.

(60) Provisional application No. 60/597,292, filed on Nov. 21, 2005.

(51) Int. Cl.
*A63B 53/04* (2006.01)

(52) U.S. Cl. ..... 473/288; 473/307; 473/309; 473/345

(58) Field of Classification Search ..... 473/288, 473/306–307, 309, 239, 296, 298–299, 345
See application file for complete search history.

(56) References Cited

U.S. PATENT DOCUMENTS 5,039,098 A 8/1991 Pelz
5,388,827 A 2/1995 Reynolds, Jr.
5,513,844 A * 5/1996 Ashcraft et al. ..... 473/288
6,273,828 B1 * 8/2001 Wood et al. ..... 473/246
6,634,957 B2 * 10/2003 Tseng ..... 473/306
6,890,269 B2 5/2005 Burrows
7,083,529 B2 * 8/2006 Cackett et al. ..... 473/309
7,226,364 B2 * 6/2007 Helmstetter ..... 473/307
2004/0132540 A1 * 7/2004 Tseng ..... 473/306

* cited by examiner

*Primary Examiner*—Stephen L. Blau
(74) *Attorney, Agent, or Firm*—R. Michael West

(57) ABSTRACT

A golf club kit having selectively interchangeable heads and shafts. The upper face of a club head is provided with hosel having a recessed sleeve with an open ends. A receiver, having a bore provided with spline grooves, is secured within the sleeve. A recessed screw port, axially aligned with the bore and the sleeve, is provided in the head's lower face. A club shaft includes a hosel connector on its lower end. The connector has a lower portion provided with external splines and an internally threaded bore, and an upper portion with a circumferential flange. The hosel connector of a selected shaft is inserted into the receiver of a selected club. A screw is passed upwardly through the screw port and is threadably installed within the bore of the hosel connector. The hosel connector flange is compressed securely against the upper end of the receiver.

17 Claims, 2 Drawing Sheets

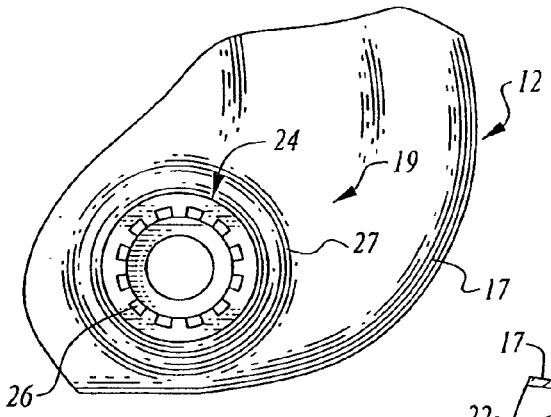
Fig. 6
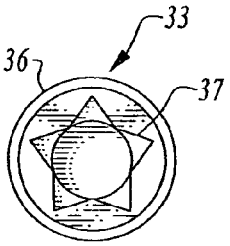
Fig. 10
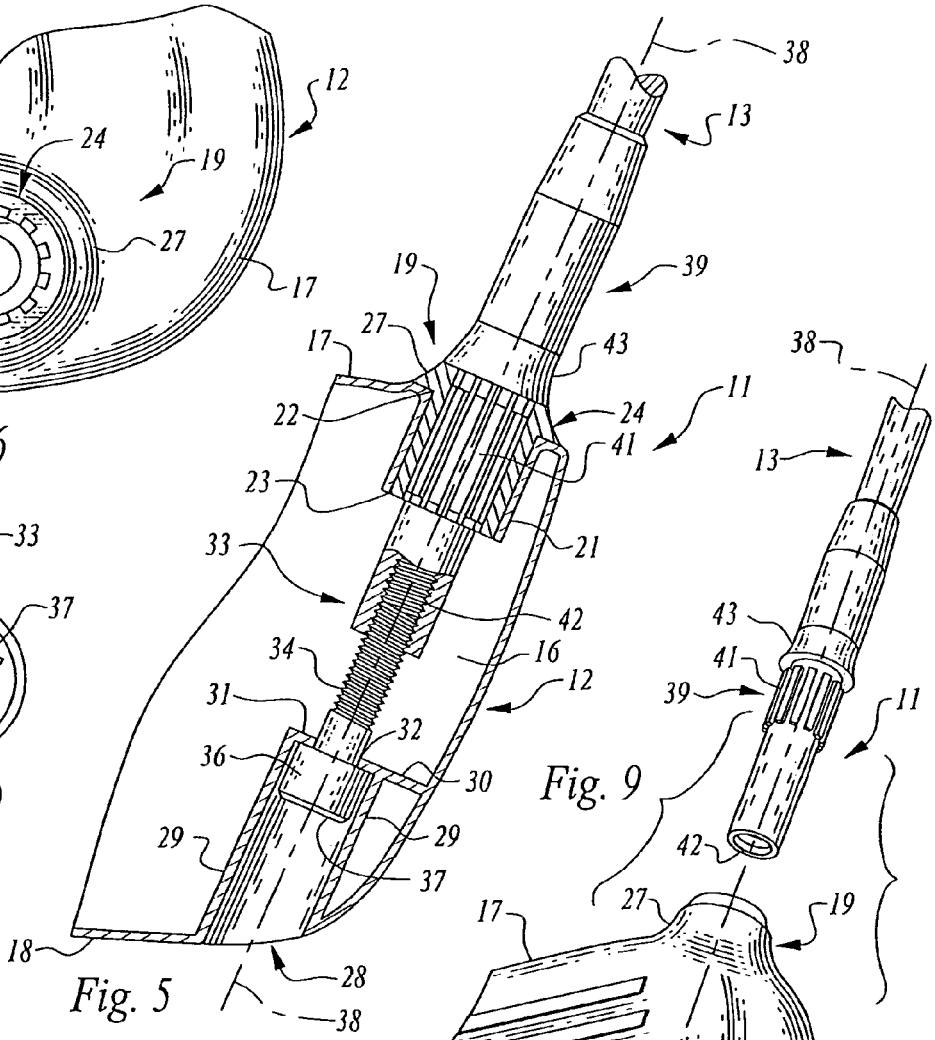
Fig. 5
Fig. 9
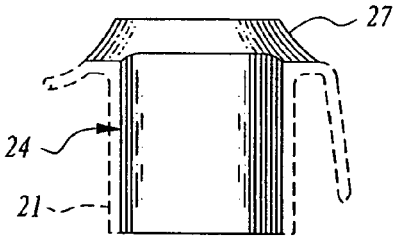
Fig. 7
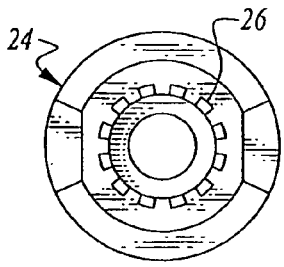
Fig. 8
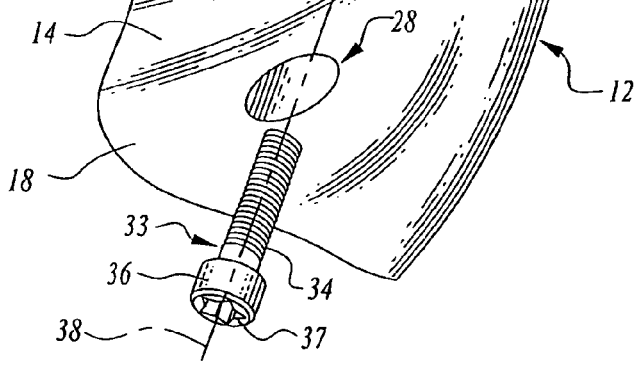

GOLF CLUB AND KIT HAVING INTERCHANGEABLE HEADS AND SHAFTS

This is a Continuation of Ser. No. 11/595,146, filed Nov. 10, 2006 now abandoned.

PRIORITY CLAIM

Pursuant to the provisions of 35 U.S.C. § 119(e)(1), Applicant claims the priority of U.S. Provisional Patent Application Ser. No. 60/597,292, filed Nov. 21, 2005.

BACKGROUND OF THE INVENTION

1. Field of the Invention

The invention relates generally to golf clubs having detachable heads and shafts. More particularly, the invention pertains to a golf club and a related kit in which various selected club heads and shafts may be interchanged and adapted to suit the needs of the user.

2. Description of the Prior Art

Golf clubs having removable shafts are well represented in the prior art. For example, in U.S. Pat. No. 5,388,827, granted to Reynolds, Jr., three embodiments of a golf putter with a removable shaft are disclosed. A keyway engaged by various shaft locking means, prevents the shaft from rotating. A screw or a double threaded allen bolt threadably engages the lower end of the shaft, and secures it within a bore in the club head.

In U.S. Pat. No. 6,890,269, issued to Burrows, a temporary golf club shaft-component connection is illustrated. A compression nut, an adapter insert with a lower pin, an adapter socket, and an anchor member are used to secure the lower tip of a shaft within the hosel of a club head. Splines are provided on the adapter insert and spline grooves are provided within the adapter socket.

A golf club having an aligning and quick connect-disconnect coupling between the golf club shaft and the club head is shown in U.S. Pat. No. 5,039,098, to Pelz. This arrangement uses an angular alignment surface on the lower end of the shaft which cooperates with an angular alignment stop formed within the heel of the golf club head. A bore, provided within the end of the shaft, is engaged by a machine screw to secure the shaft within the hosel of the club.

SUMMARY OF THE INVENTION

The present invention comprises a golf club kit having selectively interchangeable heads and shafts. In this manner, the golfer may experiment with different combinations of golf club heads and shafts, to obtain the optimum golf club construction for the needs of that golfer. In addition, the golf club construction allows the selected shaft to be quickly and easily re-positioned into a plurality of rotational positions with respect to the selected club head, again to optimize the performance of the golf club for the golfer.

The upper face of a club head includes a shaft hosel, provided with a recessed sleeve therein. The recessed sleeve includes sidewalls, an open top, and an open bottom. A receiver, having a bore provided with a plurality of spline grooves, is secured within the sleeve. The receiver fits snugly within the sleeve and may be epoxy glued or welded to resist rotation or accidental removal. A recessed, elongated screw port is provided in the lower face of the club head. The screw port is axially aligned with the open bottom in the floor of the sleeve and the bore in the receiver.

The club shaft includes a conventional hand grip on its upper end and a hosel connector on its lower end. The hosel connector has a lower portion provided with a plurality of external splines. The lower portion is also provided with a threaded bore having an open end. The upper portion of the hosel includes a circumferential flange, having an downwardly and outwardly flaring, arcuate sidewall.

The hosel connector of a selected shaft is inserted into the receiver of a selected club head in a selected rotational position. The threaded end of a headed screw is passed upwardly through a passageway in the upper end wall of the screw port. The screw end is threadably installed within the bore of the hosel connector. The head of the screw tightens against the end wall, and the hosel connector flange is compressed securely against the upper end of the receiver.

BRIEF DESCRIPTION OF THE DRAWINGS

FIG. 5 is a cross-sectional view taken on the line 5-5, shown in FIG. 3;

FIG. 6 is a fragmentary, top plan view of a driver head, showing the upper end of the receiver and plurality of spline grooves;

FIG. 7 is a side elevational view of the receiver, showing the sleeve and a portion of the head body in phantom line;

FIG. 8 is a bottom plan view of the receiver;

FIG. 9 is a fragmentary, exploded, perspective view showing the driver head, the hosel connector, and the screw; and, FIG. 10 is an end elevational view of the screw head, showing the star-shaped driver recess.

DETAILED DESCRIPTION OF THE PREFERRED EMBODIMENT

Figure 1:
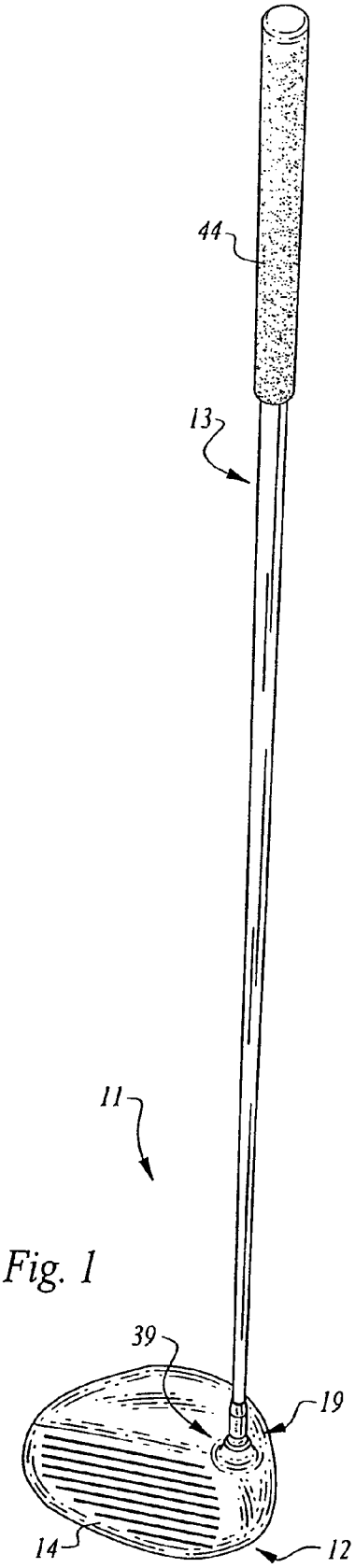
FIG. 1 is a perspective view of a golf club provided with the interchangeable club head and shaft arrangement made in accordance with the teachings of the present invention.

Making particular reference to FIG. 1, the golf club 11 of the present invention includes a club head 12 and a shaft 13. In the first embodiment to be described, club head 12 is in the configuration of a driver. Club head 12 is preferably hollow and manufactured from a metal or a metal alloy, such as titanium. So constructed, it is both lightweight and sufficiently strong to withstand the rigors of playing the game of golf. Typically, the main body of club head 12 is cast in one piece, and the impact face 14 is welded over the front opening of the main body to enclose the hollow 16. This construction is set forth only by way of example, as the club head could be manufactured as a solid body and it could also be manufactured from a plurality of separate castings or parts which are assembled in the course of manufacture.

Club head 12 includes an upper face 17 and a lower face 18. Upper face 17 is provided with a hosel 19 including a recessed sleeve 21. Sleeve 21 is preferably right-circular cylindrical in configuration, and includes an open top 22 and an open bottom 23. A hosel receiver 24, is provided with a bore 26 having a plurality of spline grooves. Receiver 24 also includes a peripheral flange 27 around its upper end, including an outer side with an arcuate surface. Receiver 24 may be secured within sleeve 21 through the use of epoxy glue. Alternatively, peripheral flange 27 may be welded to an adjacent surface of the club head 12.

A recessed screw port 28 is provided in the lower surface 18 of the club 12. Port 28 is elongated, including a right-circular cylindrical side wall 29, a side brace 30, and a transverse upper end 31. A passageway 32 is provided within upper end 32, to pass a screw 33. Preferably, left-handed threads 34 are provided on the end of screw 33, to discourage any tendency for the screw to loosen during use of the club 11. The screw 33 also includes a head 36 provided with a star-shaped driver recess 37. As shown most clearly in FIG. 5, port 28 has an axis 38 which is aligned with passageway 32, bore 26, and shaft 13.

Club shaft 13 includes a hosel connector 39 secured over its lower end. The hosel connector 39 has a lower portion provided with a plurality of external splines 41, oriented so they are generally parallel to axis 38. An internally threaded open bore 42, axially coincident with axis 38, is also proved within the lower portion. An upper portion of connector 39 is provided with a circumferential flange 43. Shaft 13 is preferably constructed from carbon fiber material, although tubular metals and other material may be suitable and, in fact, desired by certain golfers. A conventional grip 44 is provided on the upper end of shaft 13, for convenient and comfortable gripping by the golfer.

In use, the golfer selects a particular shaft 13 and a particular club head 12. This selection process may be pre-determined in the sense that the golfer knows the precise combination of shaft and club head necessary to assemble the desired golf club 11. Or, the process may initially be indeterminate, where the golfer likes a particular shaft 13, but does not know which club head 12 is optimum for his or her swing and use. It may also be the case that the golfer likes a particular club head 12, but desires to experiment with different shafts 13. The golf club 12 of the present invention allows the user to assemble a particular pre-determined combination of a shaft and a club head, or to experiment with different shaft and club head combinations. In the latter circumstance, the golf club 11 may also be viewed as a kit, comprised of a single shaft with multiple club heads, a single club head with multiple shafts, or multiple shafts with multiple club heads.

Once the selection has been made, the hosel connector 39 of a selected shaft 13 is inserted into the hosel receiver 24 of a selected club head 12. To secure the shaft 13 within the club head 12, a screw installation and removal tool 46 is utilized. Tool 46 is of conventional design, and includes features which are handy for the present application. Tool 46 includes a handle 47, a rachet direction control 48, and a bit coupler 49. A bit 51, including a male star element 52 corresponding in configuration to driver recess 37, is secured to coupler 49. Tool 46 is used to pass screw 33 upwardly through screw port 28 and passageway 32. Owing to the existing axial alignment of structural elements, continued urging of the screw upwardly will effect a mate of the end of the screw 33 and the bore 42 in connector 39.

Rotation of the handle of tool 46 will threadably install the screw 33 within the bore 42 and draw shaft 13 and club head 12 together. In addition, as screw 33 is further tightened, circumferential flange 43 and peripheral flange 27 are compressed together in tight relation. The outer side of the flanges 43 and 27 have generally matching arcuate configurations, providing a smooth and pleasing visual transition between the two structures.

It should also be noted that shaft 13 may be installed within club head 12 in a plurality of rotational positions owing to the spline and spline groove compatibility for multiple coupling positions. This is a desirable feature for at least several reasons. First, some grips 44 may have flats or other surface contours which make the shaft better for gripping with a certain rotational orientation between the shaft and the club head. In addition, certain shafts have better performance, particularly for driving activities, when they are oriented in a particular rotational position with respect to the swinging and impact forces. It is believed that this characteristic may be attributable to manufacturing techniques used in making the shafts. In any event, the rotationally adjustable feature for the shaft 13 of the golf club 11 of the present invention, allows appropriate adjustments to be made as needed.

Figure 2:
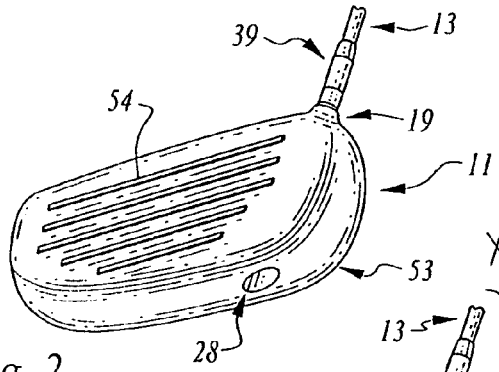
FIG. 2 is a fragmentary, perspective view of a putter or a wedge club head, showing the screw port in the lower face of the head.
Figure 3:
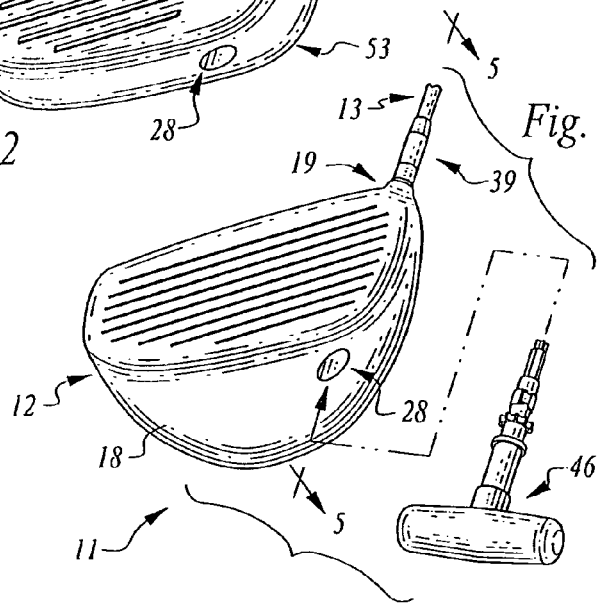
FIG. 3 is a fragmentary, perspective view of a driver club head, showing the manner in which the screw installation and removal tool is inserted into the screw port for a shaft installation or removal.
Figure 4:
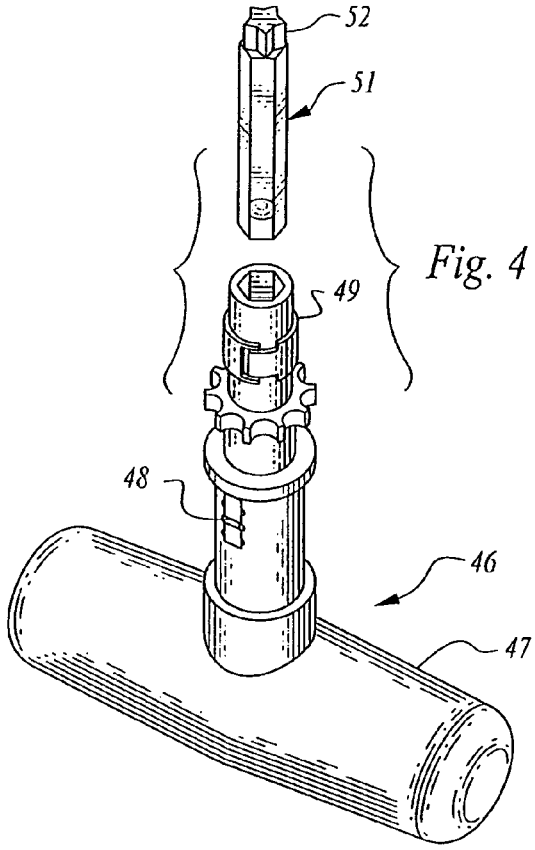
FIG. 4 is an exploded perspective view of the screw installation and removal tool showing the star driver bit.

A second embodiment of the golf club 11, simply involves the use of a club head having a structurally different design to be used for a different purpose other than for driving. To that end, a putter or iron club head 53, is shown in FIG. 2. Club head 53 may include an impact face 54 which is appropriate for the applications of chipping or putting. In other words, if head 53 is an iron, it will typically have an impact face 54 lying in a plane which is not normal to the playing field on impact with the ball. On the other hand, if head 53 is a putter, it usually has an impact face 54 which lies in a plane generally perpendicular to the playing field on impact with the ball. In addition, both putters and irons tend to have a more compact configuration than drivers, and tend to be solid in construction. However, notwithstanding these differences, the features of the present invention are readily adapted for use with putters or irons, and the same flexibility in changing heads and shafts as disclosed above, is provided.

The invention claimed is:

1. A golf club comprising:

a. a club head having an upwardly directed upper face and a lower face, said upper face attached to a sleeve, said sleeve being recessed into said club head entirely below said upper face, said lower face being provided with a recessed screw port having a passageway in an upper end thereof;

b. a receiver, said receiver having a bore provided with a plurality of spline grooves, said receiver being secured within said sleeve, said passageway in said screw port being axially aligned with said bore and said sleeve;

c. a club shaft, said shaft including a hosel connector on its lower end, said hosel connector having a lower portion provided with a plurality of external splines received by said plurality of spline grooves in said receiver, said lower portion further including an internally threaded open bore and said hosel connector further having an upper portion with a circumferential flange; and, d. a screw, said screw having a screw head within said upper end of said screw port and a threaded shaft passing upwardly through said passageway, an end of said threaded shaft being threadably installed within said bore of said hosel connector, whereby advancing said threaded shaft into said bore draws said connector flange downwardly into compression securely against an upper end of said receiver.

2. A golf club as in claim 1 in which said club head is a driver, and in which a substantial volume of said driver is hollow.

3. A golf club as in claim 1 in which said threaded bore includes left-handed threads.

4. A golf club as in claim 1 in which said shaft is carbon fiber.

5. A golf club as in claim 1 in which said lower portion of said hosel connector is installed into said receiver in a selected one of a plurality of rotational positions.

6. A golf club as in claim 1 in which said receiver includes a peripheral flange around said upper end, said peripheral flange overlying a co-extensive portion of said upper face and having an outer side.

7. A golf club as in claim 6 in which said outer side of said peripheral flange and an outer side of said circumferential flange have substantially matching arcuate configurations.

8. A golf club as in claim 1 in which said screw head is provided with a star-shaped driver recess.

9. A golf club kit comprising:

a. a plurality of club heads, each said club head having an upwardly directed upper face and a lower face, said upper face attached to a sleeve, said sleeve being recessed into said club head entirely below said upper face, said lower face being provided with a recessed screw port having a passageway in an upper end thereof;

b. a receiver for a respective one of each of said club heads, each said receiver having a bore provided with a plurality of spline grooves, said receiver being secured within said sleeve, said passageway in said screw port being axially aligned with said bore and said sleeve;

c. a club shaft, said shaft including a hosel connector on its lower end, said hosel connector having a lower portion provided with a plurality of external splines received by said plurality of spline grooves in the receiver of a selected one of said club heads, said lower portion further including an internally threaded open bore, and said hosel connector further having an upper portion with a circumferential flange; and, d. a screw, said screw having a screw head within said upper end of said screw port and a threaded shaft passing upwardly through said passageway within a selected one of said club heads, an end of said threaded shaft being threadably installed within said bore of said hosel connector, whereby advancing said threaded shaft into said bore draws said hosel connector flange downwardly into compression securely against an upper end of said receiver of said selected one of said club heads.

10. A golf club kit as in claim 9 in which said club heads are drivers, and in which a substantial volume of each of said drivers is hollow.

11. A golf club kit as in claim 9 in which said lower portion of said hosel connector is installed into said receiver of each of said club heads in a selected one of a plurality of rotational positions.

12. A golf club kit as in claim 9 in which said receiver of each of said club heads includes a peripheral flange around said upper end, said peripheral flange overlying a co-extensive portion of said upper face and having an outer side, said outer side of said peripheral flange and an outer side of said circumferential flange having substantially matching arcuate configurations.

13. A golf club kit comprising:

a. a club head, said club head having an upwardly directed upper face and a lower face, said upper face attached to a sleeve, said sleeve being recessed into said club head entirely below said upper face, said lower face being provided with a recessed screw port having a passageway in an upper end thereof;

b. a receiver, said receiver having a bore provided with a plurality of spline grooves, said receiver being secured within said sleeve, said passageway in said screw port being axially aligned with said bore and said sleeve;

c. a plurality of club shafts, each said club shaft including a hosel connector on its lower end, each said hosel connector having a lower portion provided with a plurality of external splines adapted to be received by said plurality of spline grooves in said receiver of said club head, said lower portion further including an internally threaded open bore, and said hosel connector further having an upper portion with a circumferential flange; and, d. a screw, said screw having a screw head within said upper end of said screw port and a threaded shaft passing upwardly through said passageway, an end of said threaded shaft being threadably installed within the bore of a selected one of said club shafts, whereby advancing said threaded shaft into said bore draws said hosel connector flange of said selected one of said club shafts downwardly into compression securely against an upper end of said receiver of said club head.

14. A golf club kit as in claim 13 in which said club head is a driver, and in which a substantial volume of said driver is hollow.

15. A golf club kit as in claim 13 in which said lower portion of said hosel connector of each of said shafts is installed into said receiver in a selected one of a plurality of rotational positions.

16. A golf club kit as in claim 13 in which said receiver includes a peripheral flange around said upper end, said peripheral flange overlying a co-extensive portion of said upper face and having an outer side.

17. A golf club kit as in claim 16 in which said outer side of said peripheral flange and an outer side of said circumferential flange have substantially matching arcuate configurations.

* * * * *